United States Patent [19]

Winter, III et al.

[11] 4,353,794

[45] Oct. 12, 1982

[54] PROCESS FOR THE SOLVENT EXTRACTION OF AROMATICS AND THE RECOVERY OF AN AROMATICS-FREE NON-AROMATIC PRODUCT FROM A HYDROCARBON FEEDSTOCK

[75] Inventors: George R. Winter, III, Mt. Prospect; William H. Maier, Hoffman Estates; K. N. Srinivas Prabhu, Arlington Heights, all of Ill.

[73] Assignee: UOP Inc., Des Plaines, Ill.

[21] Appl. No.: 210,633

[22] Filed: Nov. 26, 1980

[51] Int. Cl.[3] ..... C10G 21/00; C10G 21/06; C10G 21/28

[52] U.S. Cl. ..... 208/321; 208/325

[58] Field of Search ..... 208/321, 325

[56] References Cited

U.S. PATENT DOCUMENTS

| | | | |
|---|---|---|---|
| 2,773,918 | 12/1956 | Stephens | 260/674 |
| 3,308,059 | 3/1967 | Deal | 208/325 |
| 3,338,823 | 8/1967 | Voetter | 208/321 |
| 3,361,664 | 1/1968 | Broughton et al. | 208/313 |
| 3,435,087 | 3/1969 | Broughton | 208/325 |
| 3,537,984 | 11/1970 | Thompson | 208/325 X |
| 3,544,453 | 12/1970 | Thompson | 208/325 X |
| 4,046,676 | 9/1977 | Aselin | 208/321 |

*Primary Examiner*—Delbert E. Gantz
*Assistant Examiner*—Glenn A. Caldarola
*Attorney, Agent, or Firm*—James R. Hoatson, Jr.; Robert W. Welch; William H. Page, II

[57] ABSTRACT

A process for the solvent extraction of aromatic hydrocarbons from a mixture thereof with non-aromatic hydrocarbons, and for the recovery of a non-aromatic fraction substantially free of aromatic hydrocarbons, is disclosed. Said mixture is treated with an aromatic-selective solvent in a first extraction zone to provide an aromatic-rich solvent stream and a non-aromatic raffinate stream. The rich solvent stream is treated in a first solvent recovery zone to provide a high purity aromatic stream and a lean solvent stream. One portion of the lean solvent stream is recycled to the first extraction zone, and residual aromatic hydrocarbons are stripped from the remaining portion. This aromatics-free solvent is then utilized to extract residual aromatics from a fraction of the non-aromatic raffinate to provide a high purity paraffin stream.

6 Claims, 1 Drawing Figure

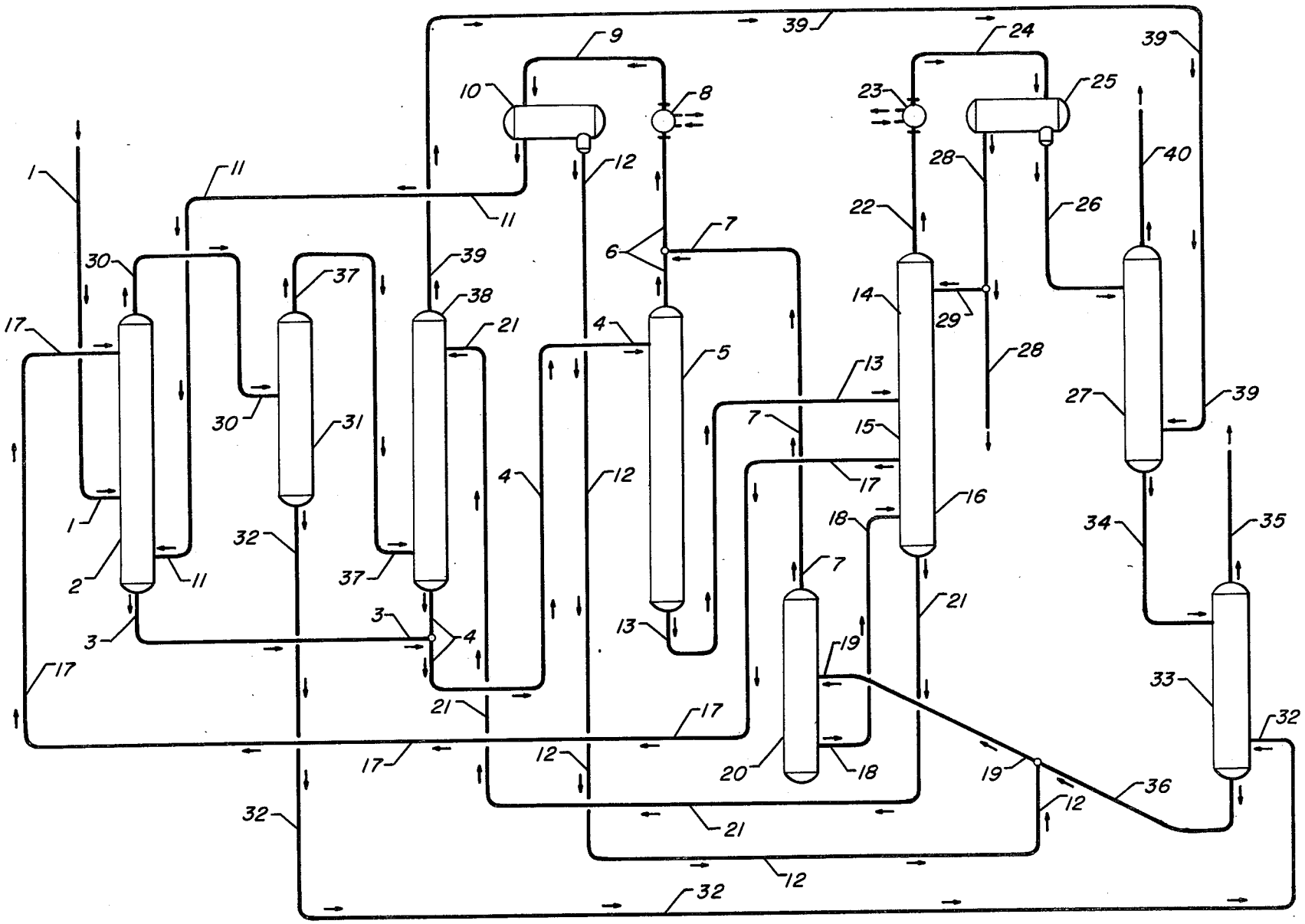
1
2
3
4
5
6
7
8
9
10
11
12
13
14
15
16
17
18
19
20
21
22
23
24
25
26
27
28
29
30
31
32
33
34
35
36
37
38
39
40

PROCESS FOR THE SOLVENT EXTRACTION OF AROMATICS AND THE RECOVERY OF AN AROMATICS-FREE NON-AROMATIC PRODUCT FROM A HYDROCARBON FEEDSTOCK

The present invention relates to the solvent extraction of aromatic hydrocarbons from a hydrocarbon feedstock comprising a mixture thereof with non-aromatic hydrocarbons. More particularly, this invention relates to the solvent extraction of aromatic hydrocarbons from a hydrocarbon feedstock, and the recovery of a non-aromatic fraction from the hydrocarbon raffinate substantially free of aromatic hydrocarbons.

In an aromatics extraction process typical of the prior art, a mixed hydrocarbon feedstock is treated in an extraction zone by contact with an aromatics-selective solvent at conditions to provide an aromatics-rich solvent and a non-aromatic raffinate. The aromatics-rich solvent is recovered from the extraction zone and passed to a separation zone which will generally comprise one or more fractionation columns operated at conditions to remove residual non-aromatic hydrocarbons and recover a high purity aromatic extract and a lean solvent. The non-aromatic hydrocarbons thus removed are normally returned to the extraction zone to serve as reflux. Because the solvents commonly employed in the extraction process are generally unstable at elevated temperatures, it is common practice to recover the aromatic extract with the aid of steam stripping—the aromatic extract being subsequently separated from the steam condensate and passed to a fractionation train wherein it is separated into its component parts.

The aromatic extraction process which has been broadly summarized above is clearly set forth by D. B. Broughton et al., in U.S. Pat. No. 3,361,664, wherein the solvent comprises sulfolane and water. A typical aromatic extraction process wherein the solvent composition comprises polyalkylene glycol and water is disclosed by J. H. Stephens in U.S. Pat. No. 2,773,918. These patents, and other published literature, clearly set forth typical processing steps and operating conditions for the aromatic extraction zone which produce a non-aromatic raffinate and an aromatic-rich solvent, and for the subsequent separation zone wherein the aromatic-rich solvent may be separated to provide a high purity aromatic extract, a lean solvent, and the aforementioned residual non-aromatic hydrocarbons.

It is known that the aforementioned non-aromatic raffinate is recovered from the extraction zone containing measurable amounts of solvent. The solvent may be present partly as a soluble component of the raffinate in low concentration, and partly as an entrained dispersion of a free solvent phase due to the turbulence encountered in the extraction zone. In any case, the solvent must be recovered, not only because it might interfere with the subsequent processing or use of the raffinate, but also because a continuous loss of solvent in this manner would be economically prohibitive. Accordingly, the solvent is typically recovered by distilling the raffinate or, more preferably, by an extraction with water.

The water-treated raffinate will be recovered substantially free of solvent and will generally contain less than about 500 ppm aromatics. While this raffinate, principally comprising hexanes, heptanes, and octanes, is generally useful as a solvent, said aromatics render the raffinate unsuitable for certain specialty uses, such as, for example, the solvent extraction of vegetable oils.

It is therefore an object of this invention to present a process for the solvent extraction of aromatic hydrocarbons from a mixture thereof with non-aromatic hydrocarbons, said process affording an improved recovery of non-aromatic hydrocarbons substantially free of aromatic hydrocarbons.

In one of its broad aspects, the present invention embodies a process for the solvent extraction of aromatic hydrocarbons from a mixture thereof with non-aromatic hydrocarbons and the recovery of a non-aromatic hydrocarbon fraction substantially free of aromatic hydrocarbons, which process comprises the steps of (a) treating said mixture in a first extraction zone in contact with a water-soluble, aromatics-selective solvent at conditions to provide an aromatic-rich solvent stream and a first raffinate stream comprising non-aromatic hydrocarbons and residual solvent; (b) treating said aromatic-rich solvent stream in a first separation zone at conditions to separate substantially all of the residual non-aromatic hydrocarbons containing therein; (c) treating the resulting aromatic-rich solvent stream in a first solvent recovery zone in contact with stripping steam at conditions to provide a high purity aromatics stream and a lean solvent stream; (d) recycling a major portion of said lean solvent stream to said first extraction zone, and recovering said high purity aromatics stream; (e) treating a minor portion of said lean solvent stream in a second solvent recovery zone in contact with stripping steam at conditions to provide a lean solvent stream substantially free of residual aromatics for use in accordance with step (h); (f) treating the raffinate stream recovered from said first extraction zone in a second separation zone at conditons to provide a bottoms fraction comprising the higher boiling non-aromatic components and residual solvent as a second raffinate stream, and an overhead fraction comprising the lower boiling non-aromatic component as a third raffinate stream; (g) treating said second raffinate stream in contact with an aqueous stream in a second water-wash zone at conditions to separate a solvent-containing aqueous stream and recovering said second raffinate stream substantially solvent-free; (h) treating said third raffinate stream in a second extraction zone in contact with the lean solvent stream provided pursuant to step (e) at conditions to extract the residual aromatic hydrocarbons contained therein; and, (i) treating the resulting raffinate stream in contact with an aqueous stream in a first water-wash zone at conditions to separate a solvent-containing aqueous stream and recover said third raffinate stream substantially free of aromatic hydrocarbons.

Other objects and embodiments of this invention will become apparent in the following detailed specification.

The solvent extraction of aromatic hydrocarbons from a hydrocarbon feedstock is a well-known refinery operation. A typical aromatics-selective solvent is tetrahydrothiophene, 1-1 dioxide, commonly known as sulfolane. Also employed are those sulfolane derivatives corresponding to the structural formula:

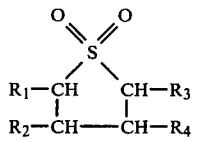

wherein $R_1$, $R_2$, $R_3$ and $R_4$ are indepenently selected from the group consisting of hydrogen, an alkyl radical containing from about 1 to about 10 carbon atoms, an aralkyl radical containing from about 7 to about 12 carbon atoms, and an alkoxy radical containing from about 1 to about 8 carbon atoms. Other related solvents include the sulfolenes, such as 2-sulfolene or 3-sulfolene. Still other typical aromatics-selective solvents are such as 2-methylsulfolane, 2,4-dimethylsulfolane, methyl-2-sulfonyl ether, N-aryl-3-sulfonyl amine, 2-sulfonyl acetate, diethyleneglycol, various polyethylene glycols, dipropylene glycol, various polypropylene glycols, dimethylsulfoxide, N-methylpyrrolidone and the like. A particularly preferred aromatics-selective solvent for use in the process of the present invention is sulfolane having the following structural formula:

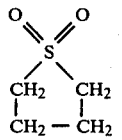

The solvent composition herein contemplated comprises a mixture of water and one or more of the solvents heretofore mentioned. Particularly preferred is a mixture of sulfolane and water. In the extraction of aromatic hydrocarbons from a hydrocarbon mixture, it is known that paraffins are the least soluble followed in increasing order of solubility by naphthenes, olefins, diolefins, acetylenes, sulfur-containing hydrocarbons, nitrogen-containing hydrocarbons, oxygen-containing hydrocarbons and aromatic hydrocarbons. It is the practice to regulate the solubility of the hydrocarbons by varying the water content of the solvent composition. Thus, by adding more water to the solvent, the solubility of all components of the hydrocarbon mixture is decreased but the solubility difference between the components (selectivity) is increased. The net effect is to decrease the number of contacting stages required to achieve a given purity of the aromatic extract, or to increase the resulting purity when the number of contacting stages is held constant.

The ability to process water in the system provides a further processing benefit in that it introduces a relatively volatile material into the fractionation system wherein the aromatic extract is separated from the aromatics-rich solvent composition. In the fractionation process, the water in the solvent is vaporized, at least in part, to provide assistance in stripping all traces of non-aromatic hydrocarbons from the aromatics-rich solvent, and in the subsequent stripping of substantially all of the aromatics from said aromatics-rich solvent. It is therefore the practice to provide that the solvent composition contain from about 0.1 to about 20 wt.% water. When the solvent is sulfolane, it is preferred that the solvent composition comprise from about 0.1 to about 2.0 wt.% water, while a solvent composition comprising a polyalkylene glycol will preferably further comprise from about 6 to about 15 wt.% water.

Hydrocarbon feedstocks suitable for use herein comprise fluid hydrocarbon mixtures comprising hydrocarbons in the $C_5$–$C_{20}$ range, and preferably in the $C_6$–$C_{10}$ range, and having a sufficient aromatic concentration to economically justify their recovery. A debutanized or depentanized product from a catalytic reforming process is one particularly preferred hydrocarbon feedstock. Another suitable hydrocarbon feedstock is the liquid product from a pyrolysis process unit which has been hydrotreated to saturate olefins and remove contaminants.

In accordance with the process of the present invention, the hydrocarbon feedstock is treated in contact with said solvent in a first extraction zone at conditions to provide an aromatics-rich solvent and a first raffinate stream comprising non-aromatic hydrocarbons and residual solvent. In general, the conditions employed herein with respect to temperature and pressure are essentially the same as set out in the related prior art. Thus, the first extraction zone, as well as a hereinafter mentioned second extraction zone, is operated at an elevated temperature, and at an elevated pressure sufficient to maintain substantially liquid phase conditions therein. Suitable temperatures range from about 80° to about 400° F. with temperatures of from about 150° to about 300° F. being preferred. The extraction zone pressure is suitably in the range of from about slightly superatmospheric to about 400 psig., and preferably from about 50 to about 150 psig.

The resulting aromatics-rich solvent recovered from the first extraction zone is treated in a first separation zone at conditions to separate substantially all of the residual non-aromatic hydrocarbons retained therein. Said conditions generally include moderate pressures and a sufficiently high temperature to distill all of the non-aromatic components overhead together with some aromatics, water and solvent. Typical separation zone pressures are from subatmospheric to about 100 psig., with the top of said zone being maintained at from about −5 to about 30 psig. The bottom or reboiler temperature is dependent on the composition of the hydrocarbon feedstock and solvent. In the case of a $C_5$–$C_{10}$ hydrocarbon feedstock with sulfolane as the solvent, a temperature of from about 275° to about 380° F. is satisfactory.

Pursuant to the process of this invention, the aromatics-rich solvent recovered from the last-mentioned first separation zone is treated in a first solvent recovery zone at conditions to provide a high purity aromatics stream and a lean solvent stream. Operating conditions for the first as well as a later described second solvent recovery zone are dependent on the composition of the aromatics-rich solvent treated therein. Thus, when the aromatics-rich solvent is a $C_6$–$C_8$ aromatics-rich sulfolane, the distillation of aromatic hydrocarbons from the sulfolane is facilitated by the use of stripping steam at a reduced pressure, say from about 100 to about 600 mm Hg absolute, whereby a bottom or reboiler temperature in excess of about 380° F. is avoided to preclude thermal decomposition of the sulfolane.

The further description of the process of this invention is presented with reference to the attached schematic drawing.

The drawing represents one preferred embodiment of the invention and is not intended as an undue limitation on the generally broad scope of the invention as set out in the appended claims. Only those compressors, heaters, heat exchangers, coolers and valves are shown that are useful in the description of the process. The utilization of other miscellaneous hardware such as pumps, instrumentation and controls have been omitted as not essential to a clear understanding of the process, the use of such hardware being well within the purview of one skilled in the art.

Referring then to the drawing, a hydrocarbon feedstock, typically comprising about 60 vol.% aromatics and 40 vol.% paraffins, is introduced via line 1 into a first extraction zone 2 at a rate of about 364 bbls/hr. The hydrocarbon feedstock herein contemplated is a depentanized reformate from a catalytic reforming operation, said reformate having been rerun to substantially remove materials heavier than xylene. The first extraction zone 2, as well as a hereinafter described second extraction zone 38, is preferably a column or tower containing suitably fixed baffles, perforated trays or sieve decks, or a rotary disc contactor, although a column or tower suitably packed with beryl saddles, Rashig rings, or the like, will serve the purpose. About 1091 bbls/hr of lean solvent containing about 0.6 vol.% water is introduced into the first solvent extraction zone 2 from line 17, the lean solvent stream originating as hereinafter described. A light hydrocarbon backwash phase is charged to the lower portion of the first extraction zone 2 and serves to strip the heavier non-aromatic hydrocarbons from the aromatic-rich solvent stream. This light hydrocarbon phase, including some aromatics, enters the first extraction zone 2 from line 11 at a rate of approximately 236 bbls/hr.

The aromatic-rich solvent stream is withdrawn from the first extraction zone 2 through line 3 at a rate of about 1528 bbls/hr. This aromatic-rich solvent stream, containing about 28.6 vol.% aromatics, passes through line 3 to be combined in line 4 with an effluent stream recovered from the bottom of a second extraction zone 38 hereinafter described. This effluent stream, comprising solvent and about 6.2 vol.% paraffinic hydrocarbons, is recovered from said second extraction zone at a rate of about 291 bbls/hr, and the combined stream is continued through line 4 at a rate of about 1819 bbls/hr into a solvent stripper column 5, hereinafter referred to as a first separation zone. The aromatic-rich solvent stream is introduced into said first separation zone at a temperature of about 245° F. and at a pressure of about 5 psig.

The first separation zone 5 is operated at conditions to remove substantially all residual non-aromatic hydrocarbons from the aromatic-rich solvent stream charged thereto. An overhead vapor stream, comprising light paraffinic hydrocarbons and a small amount of aromatic hydrocarbons, leaves said first separation zone by way of line 6 at a rate of about 236 bbls/hr. This vapor stream, in admixture with a water vapor stream from line 7, is cooled to about 120° F. in a condenser 8 and then passed via line 9 into a phase separator 10 maintained at substantially atmospheric pressure conditions. The water vapor stream in line 7 contains some paraffinic hydrocarbons and originates from a hereinafter described water stripper column 20. The hydrocarbon phase that settles out in the phase separator 10 is recovered through line 11 and returned to said first extraction zone as heretofore reported. The aqueous phase, comprising a portion of the water vaporized from the solvent entering the first separation zone 5, is withdrawn via line 12 and discharged via line 19 into the water stripper column 20.

In the first separation zone 5, as the aromatic-rich solvent moves downwardly through the column, it is heated in contact with hot upwardly moving hydrocarbon and water vapors whereby substantially all of the non-aromatic hydrocarbons are stripped from the solvent phase and recovered in the overhead effluent stream through line 6. The first separation zone 5 is operated at a bottom pressure of about 10 psig., and the bottom temperature is maintained at about 350° F. by means of a reboiler which is not shown. The aromatic-rich solvent stream is withdrawn from the bottom of said first separation zone substantially free of non-aromatic hydrocarbons and transferred via line 13 to a first solvent recovery zone 14. The aromatic-rich solvent stream, comprising sulfolane, water and about 13.8 vol.% aromatic hydrocarbons, is withdrawn from the first separation zone 5 at a rate of about 1582 bbls/hr and introduced into said first solvent recovery zone at a temperature of about 325° F.

The first solvent recovery zone 14 is shown as the upper section of a solvent recovery column 15 which also houses a second solvent recovery zone 16 in the lower section. The solvent recovery column will typically comprise from about 25 to about 40 trays, from about 12 to about 30 of which are associated with the first recovery zone 14. The second solvent recovery zone 16 is in open communication with the first solvent recovery zone 14, the lower limit of the latter being defined by a lean solvent draw-off line 17.

The aromatic-rich solvent stream passing downwardly through the solvent recovery column 15 is contacted with a counter flow of hot aromatic hydrocarbon vapors and with a paraffin-free stripping steam introduced into the lower end of said column from line 18. This stripping steam originates from the bottom of a water stripper column 20. Substantially all of the aromatic hydrocarbons are stripped from the solvent in this manner so that a lean solvent stream containing 30–500 ppm aromatics is withdrawn from the first solvent recovery zone via the lean solvent draw-off line 17 at a rate of about 1091 bbls/hr. This lean solvent stream leaves the first solvent recovery zone 14 at a temperature of about 340° F. The lean solvent stream is cooled by heat exchange means, not shown, and then continued through line 17 and returned to the earlier described first extraction zone 2.

The lean solvent, containing 30–500 ppm aromatics, that continues downwardly into the second solvent recovery zone 16, is steam-stripped substantially free of the residual aromatic hydrocarbons by virtue of the aforementioned steam introduced into the bottom of the solvent recovery column 15 via line 18. The resulting lean solvent stream is withdrawn from the bottom of the second solvent recovery zone by way of line 21 at a rate of about 273 bbls/hr. This lean solvent stream, at a temperature of about 360° F., is heat exchanged suitably to reduce its temperature. The further use of this aromatics-free solvent stream is set out below.

The solvent recovery column 15 is operated at a top pressure of about 300 mm Hg absolute and at a bottom temperature of about 360° F. to assure the separation of substantially all of the aromatic hydrocarbons from the sulfolane solvent. Thus, an overhead vapor stream leaves said solvent recovery column via line 22 at a temperature of about 180° F. and at a pressure of about 300 mm Hg absolute. This vapor stream is cooled to about 100° F. in a condenser 23 and transferred through line 24 to a phase separator 25. In the phase separator 25, an aqueous phase, resulting from the condensation of steam introduced into the solvent recovery column 15, is allowed to settle out and removed through line 26. This aqueous phase is subsequently utilized in a first water-wash zone 27 as hereinafter described. A high purity aromatic hydrocarbon phase is recovered from said phase separator by way of line 28. One portion is recycled by way of line 29 to the solvent recovery column 15 as reflux, and the balance is continued through line 28 at a rate of about 218 bbls/hr to an aromatics fractionation train which is not shown.

Referring back to the first extraction zone 2, a substantially non-aromatic raffinate stream, hereinafter referred to as the first raffinate stream, is withdrawn from said first extraction zone by way of an overhead line 30. This first raffinate stream, containing about 2.3 vol.% aromatics and 2.1 vol% solvent, is withdrawn at a rate of about 164 bbls/hr and transferred via line 30 to a splitter column 31, hereinafter referred to as the second separation zone. This second separation zone 31 is operated at atmospheric pressure conditions with a bottom temperature of 175°–180° F. to distill a principally hexane fraction overhead at a rate of about 91 bbls/hr. A $C_6$-plus fraction, comprising about 1 vol.% sulfolane, is taken from the bottom of said second separation zone by way of line 32 at a rate of about 73 bbls/hr. This bottom fraction, hereinafter referred to as the second raffinate stream, is transferred through line 32 and introduced into the bottom portion of a water-wash zone 33. The water-wash zone, suitably a rotating disc contactor, is operated at a top pressure of about 30 psig. and a bottom pressure of about 60 psig. The second raffinate stream is washed with water recovered from the first water-wash zone 27 and charged to the second water-wash zone 33 via line 34 at a temperature of about 100° F. The second raffinate stream leaves the second water-wash zone 33 through line 35 substantially free of sulfolane and containing the residual aromatic hydrocarbons. Said second raffinate stream is recovered at a rate of about 73 bbls/hr. An aqueous stream is recovered from the bottom of the second water-wash zone 33 through line 36, and this stream is combined with the heretofore described aqueous phase withdrawn via line 12 from the phase separator 10 to form line 19 and is introduced into the water stripper column 20.

The principally hexane fraction distilled overhead from the second separation zone 31 is transferred through line 37 to the previously mentioned second extraction zone 38 which, as in the case of the first extraction zone 2, is preferably a perforated tray contactor. The heretofore described aromatic-free solvent stream recovered from the second solvent recovery zone 16 by way of line 21, is introduced into the second extraction zone 38 at a rate of about 273 bbls/hr. As the hydrocarbon stream moves upwardy through said extraction zone, the residual aromatic hydrocarbons contained therein are extracted by the counterflowing solvent stream, and said hydrocarbon stream, hereinafter referred to as the third raffinate stream, is recovered from the second extraction zone 38 at the aforesaid rate of about 91 bbls/hr and transferred to the heretofore mentioned first water-wash zone 27 by way of line 39 essentially aromatic-free. This third raffinate stream, comprising about 1 vol.% sulfolane, enters the lower portion of said water-wash zone at a temperature of about 100° F. The first water-wash zone 27, suitably a rotating disc contactor, is operated at a top pressure of about 30 psig. and at a bottom pressure of about 60 psig. The third raffinate stream is washed free of sulfolane with water recovered from the phase separator 25 by way of line 26. The water-washed raffinate is recovered from the water-wash zone via line 40 essentially aromatics-free.

By the device of providing a second solvent recovery zone as herein described, a lean solvent stream essentially free of aromatics is available to extract residual aromatic hydrocarbons from the non-aromatic raffinate, or any fraction thereof, and provide a high purity paraffin stream.

We claim as our invention:

1. A process for the solvent extraction of aromatic hydrocarbons from a mixture thereof with non-aromatic hydrocarbons and the recovery of a non-aromatic hydrocarbon fraction substantially free of aromatic hydrocarbons, which comprises the steps of:

(a) treating said mixture in a first extraction zone in contact with a water-soluble, aromatics-selective solvent at conditions to provide an aromatics-rich solvent stream and a first raffinate stream comprising non-aromatic hydrocarbons and residual solvent;

(b) treating said aromatics-rich solvent stream in a first separation zone at conditions to separate substantially all of the residual non-aromatic hydrocarbons retained therein;

(c) treating the resulting aromatics-rich solvent stream in a first solvent recovery zone in contact with stripping steam at conditions to provide a high purity aromatics stream and a lean solvent stream;

(d) recycling a major portion of said lean solvent stream to said first extraction zone, and recovering said high purity aromatics stream;

(e) treating a minor portion of said lean solvent stream in a second solvent recovery zone in contact with stripping steam at conditions to provide a lean solvent stream substantially free of residual aromatics for use in accordance with step (h);

(f) treating the raffinate stream recovered from said first extraction zone in a second separation zone at conditions to provide a bottoms fraction comprising the higher boiling non-aromatic components and residual solvent as a second raffinate stream, and an overhead fraction comprising the lower boiling non-aromatic component as a third raffinate stream;

(g) treating said second raffinate stream in contact with an aqueous stream in a second water-wash zone at conditions to separate a solvent-containing aqueous stream and recover said second raffinate stream substantially solvent-free;

(h) treating said third raffinate stream in a second extraction zone in contact with the lean solvent stream provided pursuant to step (e) at conditions to extract residual aromatic hydrocarbons contained therein; and, (i) treating the resulting raffinate stream in contact with an aqueous stream in a first water-wash zone at conditions to separate a solvent-containing aqueous stream and recover said third raffinate stream substantially free of aromatic hydrocarbons.

2. The process of claim 1 further characterized in that said aromatic hydrocarbons are a mixture of $C_6$–$C_8$ aromatic hydrocarbons and said non-aromatic hydrocarbons are a mixture of $C_6$-plus paraffinic hydrocarbons.

3. The process of claim 1 further characterized with respect to step (f) in that said raffinate stream treated in said second separation zone comprises a mixture of $C_6$–$C_8$ paraffins, and said raffinate stream is treated at conditions to provide a bottoms fraction comprising $C_6$-plus paraffinic hydrocarbons and residual solvent as a second raffinate stream, and an overhead fraction comprising hexane as a third raffinate stream.

4. The process of claim 1 further characterized in that the residual aromatic hydrocarbons extracted from the third raffinate stream in accordance with step (h) are combined with the aromatics-rich solvent stream of step (a) and treated in said first separation zone pursuant to step (b).

5. The process of claim 1 further characterized in that said aromatics-selective solvent composition comprises a sulfolane type chemical compound of the general formula:

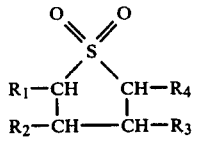

wherein $R_1$, $R_2$, $R_3$ and $R_4$ are independently selected from the group consisting of hydrogen, an alkyl radical containing from about 1 to about 10 carbon atoms, an aralkyl radical containing from about 7 to about 12 carbon atoms, and an alkoxy radical having from about 1 to about 8 carbon atoms.

6. The process of claim 1 further characterized in that said aromatics-selective solvent composition is sulfolane of the general formula:

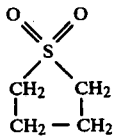

* * * * *